US007644550B2

(12) United States Patent
Meyer

(10) Patent No.: US 7,644,550 B2
(45) Date of Patent: Jan. 12, 2010

(54) ARTICULATING RAISED ACCESS FLOOR PANEL

(76) Inventor: Gary Meyer, 25813 Gateway Dr., Golden, CO (US) 80401

( * ) Notice: Subject to any disclaimer, the term of this patent is extended or adjusted under 35 U.S.C. 154(b) by 4 days.

(21) Appl. No.: 12/002,207

(22) Filed: Dec. 14, 2007

(65) Prior Publication Data

US 2009/0151271 A1 Jun. 18, 2009

(51) Int. Cl.
*E04B 1/00* (2006.01)

(52) U.S. Cl. ..... 52/263; 52/198; 52/235; 52/302.3; 454/247; 454/289; 248/158

(58) Field of Classification Search ..... 52/126, 52/126.5, 126.6, 263, 198, 506.02, 506.05, 52/511, 235, 220.1, 220.2, 302.1, 302.3; 454/241, 246, 247, 289, 290, 186, 198; 248/158
See application file for complete search history.

(56) References Cited

U.S. PATENT DOCUMENTS

| | | | | | |
|---|---|---|---|---|---|
| 1,904,077 | A | * | 4/1933 | Place | 52/511 |
| 2,725,667 | A | * | 12/1955 | Nicholas | 248/188.4 |
| 2,940,784 | A | * | 6/1960 | Fell | 74/89.35 |
| 3,087,206 | A | * | 4/1963 | Delf | 52/126.5 |
| 3,175,795 | A | * | 3/1965 | Adams | 248/188.4 |
| 3,465,996 | A | * | 9/1969 | Wedel | 248/287.1 |
| 3,511,001 | A | * | 5/1970 | Morgan, Jr. | 52/126.5 |
| 3,552,698 | A | * | 1/1971 | Kinney | 248/158 |
| 4,258,516 | A | * | 3/1981 | Mori et al. | 52/126.6 |
| 5,118,060 | A | * | 6/1992 | Spronken | 248/218.4 |
| 5,332,182 | A | * | 7/1994 | Weisz et al. | 248/188.4 |
| 5,412,914 | A | * | 5/1995 | Daw et al. | 52/126.6 |
| 5,515,655 | A | * | 5/1996 | Hoffmann | 52/126.6 |
| 5,628,157 | A | * | 5/1997 | Chen | 52/263 |
| 5,749,669 | A | * | 5/1998 | Ketteler | 403/12 |
| 5,772,356 | A | * | 6/1998 | Collins | 403/343 |
| 5,836,556 | A | * | 11/1998 | Kim | 248/188.4 |
| 5,904,009 | A | * | 5/1999 | Huang | 52/126.6 |
| 6,128,883 | A | * | 10/2000 | Hatzinikolas | 52/698 |
| 6,158,177 | A | * | 12/2000 | Blobaum | 52/208 |
| 6,256,952 | B1 | * | 7/2001 | Fahy et al. | 52/263 |
| 6,519,902 | B1 | * | 2/2003 | Scissom | 52/126.4 |
| D561,327 | S | * | 2/2008 | DeJonge et al. | D23/397 |
| 7,360,343 | B1 | * | 4/2008 | Spransy et al. | 52/263 |
| 2002/0078638 | A1 | * | 6/2002 | Huang | 52/126.6 |
| 2002/0144477 | A1 | * | 10/2002 | Chen | 52/263 |
| 2002/0178667 | A1 | * | 12/2002 | Elmer | 52/235 |
| 2003/0177723 | A1 | * | 9/2003 | Jakob-Bamberg et al. | 52/263 |
| 2004/0200161 | A1 | * | 10/2004 | Liu | 52/235 |
| 2005/0050818 | A1 | * | 3/2005 | Chen et al. | 52/263 |
| 2008/0274685 | A1 | * | 11/2008 | DeJonge et al. | 454/241 |

* cited by examiner

*Primary Examiner*—Richard E Chilcot, Jr.
*Assistant Examiner*—Matthew J. Gitlin
(74) *Attorney, Agent, or Firm*—Scott L. Terrell

(57) ABSTRACT

A precast under floor air delivery construction is provided which includes a plurality of precast concrete system having an upper base floor surface and a lower surface, a plurality of floor panel support means bearing directly to the upper base floor surface capable of an under floor air delivery between the floor panels and the upper surface, a plurality of access floor panels connected to the support means, and a fire protection barrier applied between the concrete slabs.

7 Claims, 3 Drawing Sheets

ARTICULATING RAISED ACCESS FLOOR PANEL

CROSS REFERENCE TO RELATED APPLICATIONS

Not applicable.

STATEMENT OF FEDERALLY SPONSORED RESEARCH

Not applicable.

BACKGROUND OF THE INVENTION

1. Field of the Invention

The present invention relates to raised access floor panels. In particular, it relates to a raised access floor panel having articulating corner members for interchangeable fit when supported on an existing matrix of pedestal support members.

2. Description of the Related Art

Access floors are of a double floored construction and are commonly used to create a free space between a sub-floor and the normal working environment of a room. Raised access floor systems are so constructed that floor panels are mounted on a surface of a base floor such as a concrete floor, by means of support pedestal legs, whereby the free space may be provided between the floor panels and the base floor. The pedestal support legs are stationary and are typically bolted to the surface of the base floor at a predetermined position. A corner portion of each of the floor panels is disposed at the upper end of the stationary pedestal support leg. Such systems are so constructed so as to provide an easy distribution of electric cables and ventilation duct work. Such systems are well known in the art.

For example, U.S. Pat. No. 5,048,242 to Cline discloses an access floor system having a plurality of floor panels each having a pan and a cooperating top plate. The top plate is folded over a peripheral flange of the pan to define a hemmed edge. The support pedestal assembly includes a support plate configured to support the floor panels at their corners. T-shaped stringers are joined to the support plates in a grid-like pattern. The stringers are rigidly connected to the plates or snap-on to lock tabs defined by the plates. In this manner, the pedestals support the panels at their corners and additional support is achieved at the edges of the panels by the stringers. According to this construction, each support pedestal secured to a surface of a base floor.

In yet another example, U.S. Pat. No. 5,072,557 to Nake et. al., discloses a device for fixing floor panels mounted on a surface of a base floor by means of using support legs which permit vertical adjustment of the floor panels. The fixing device includes a retainer plate, fixed to the base floor, for receiving the support legs, a support member extending vertically from the retainer plate and having an internally threaded portion, a panel holder, and a bearing member for the panel holder. The bearing member includes one end thereof threaded into the internally threaded portion of the support member for rotatable movement of the bearing member relative to the retainer plate. The bearing member is adapted to be accessible through the floor panels for operation. The panel holder is adapted to be engageable with the bearing member in order fix the floor panels.

While the foregoing systems disclose a plurality of floor panels of a type supported at a corner portion of each of the floor panels by a stationary pedestal support leg, a problem exists in the prior art because the floor panels themselves are not interchangeable in fit for support with other stationary pedestal support legs fixed on the base floor in predetermined positions which vary from room to room. This variance in position often requires that fabricators of replacement floor panels undergo a design-build approach when filling orders for a retrofit floor panel capable of support on a preexisting pedestal support system or when moving floor panels from room to room. The design-build approach is time consuming and often times requires the fabricator to redesign one panel at a time to the exacting dimensions of the remaining panels for a room for vertical and horizontal fit consistent with the preexisting pedestal support system. Therefore, what is needed is a floor panel which is designed for interchangeable fit with existing pedestal support systems having pedestal support legs fixed to a base floor at varying predetermined positions, and which is also capable of low cost mass production and inventory for rapid shipment and installation. The present invention satisfies these needs.

BRIEF SUMMARY OF THE INVENTION

It is therefore an object of the present invention to provide a floor panel which is designed for interchangeable fit with existing pedestal support systems having pedestal support legs fixed to a base floor at varying predetermined positions.

It is another object of the present invention to provide an interchangeable floor panel which is capable of low cost mass production and inventory for rapid shipment and installation.

It is another object of the present invention to provide a panel having an adjustable articulating corner portion for support of a floor panel on a fixed pedestal support leg.

It is another object of the present invention to provide a floor panel having a corner portion that is vertically adjustable with respect to a fixed pedestal support leg.

It is yet another object of the present invention to provide a panel which is universal and interchangeable in fit within a grid of a preexisting raised access floors.

To overcome the problems of the prior art and in accordance with the purpose of the invention, as embodied and broadly described herein, briefly, an articulating raised access floor panel of the type for interchangeable fit on pedestal support systems having pedestal support legs fixed to a base floor at varying predetermined positions, is provided which includes a floor panel having an upper working surface, a lower plenum surface, and four side walls defining open corner portions, an articulating corner bracket positioned below the open corner portion having an upper surface slidably connected to the lower plenum surface so that the point of connection varies linearly along a diagonal vector defined with respect to the side walls.

Additional advantages of the present invention will be set forth in part in the description that follows and in part will be obvious from that description or can be learned from practice of the invention. The advantages of the invention can be realized and obtained by the apparatus particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and together with the description explain the principles of the invention.

DETAILED DESCRIPTION OF THE DRAWINGS

Unless specifically defined otherwise all technical or scientific terms used herein have the same meaning as commonly understood by one of ordinary skill in the art to which this invention belongs.

Although any methods and materials similar or equivalent to those described herein can be used in the practice or testing of the present invention, the preferred methods and materials are now described. Reference will now be made in detail to the presently preferred embodiments of the invention examples of which are illustrated in the accompanying drawings wherein like numerals represent like features.

Figure 1:
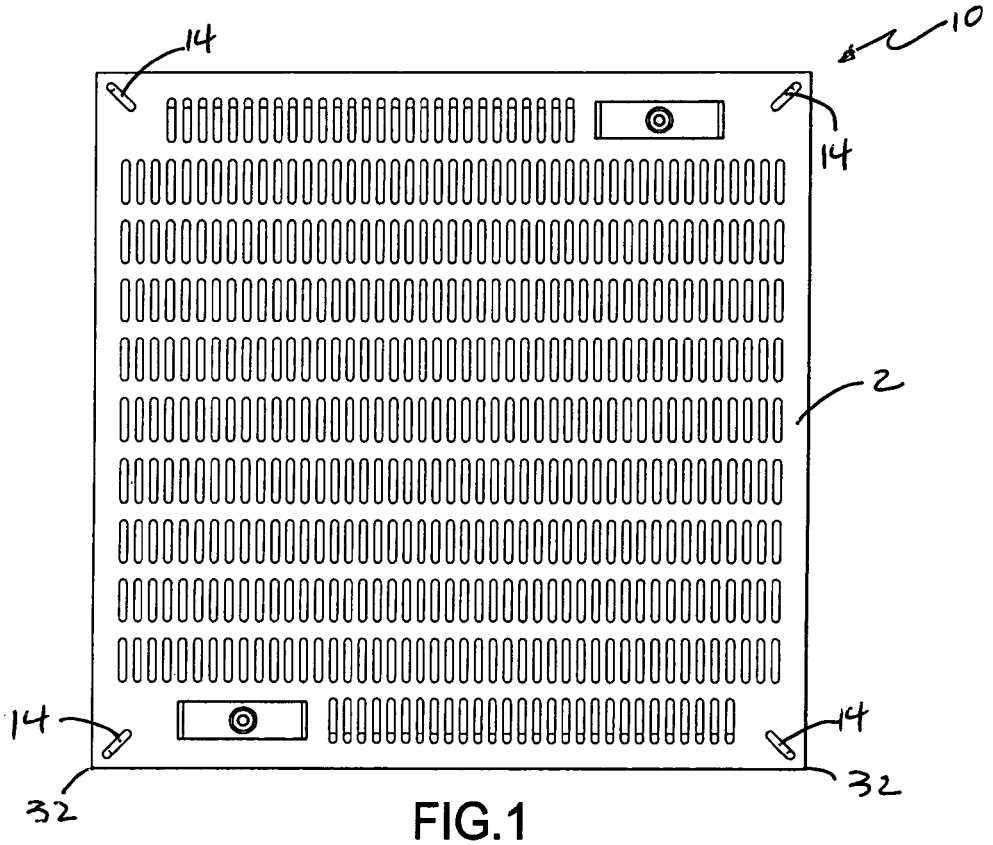
FIG. 1 is a top view of a perforated panel showing the diagonal clear slots at each corner in alignment with the diagonal vector for access to the vertical adjustment means.

The present invention provides an articulating floor panel 10 of the type for interchangeable fit on pedestal support systems having pedestal support legs fixed to a base floor at varying predetermined positions. The floor panel 10 has an upper working surface 2, and four side walls 8 with open corner portions. In FIG. 1, a top view from the upper working surface 2 of the floor panel 10 is shown. The articulating corner brackets 20 are positioned below the upper surface 2 at each open corner portion 12 of the floor panel 10. The articulating corner brackets 20 are slidably connected to the lower plenum surface 4 of the floor panel 10 so that the brackets 20 are capable of free longitudinal movement, inwardly and outwardly, along a diagonal vector defined with respect to each corner of the floor panel 10. A first diagonal clear slot 14, having a centroid along the diagonal vector, may but need not, be provided at each corner of the floor panel 10 when the floor panel 10 includes a vertical adjustment feature.

Figure 2:
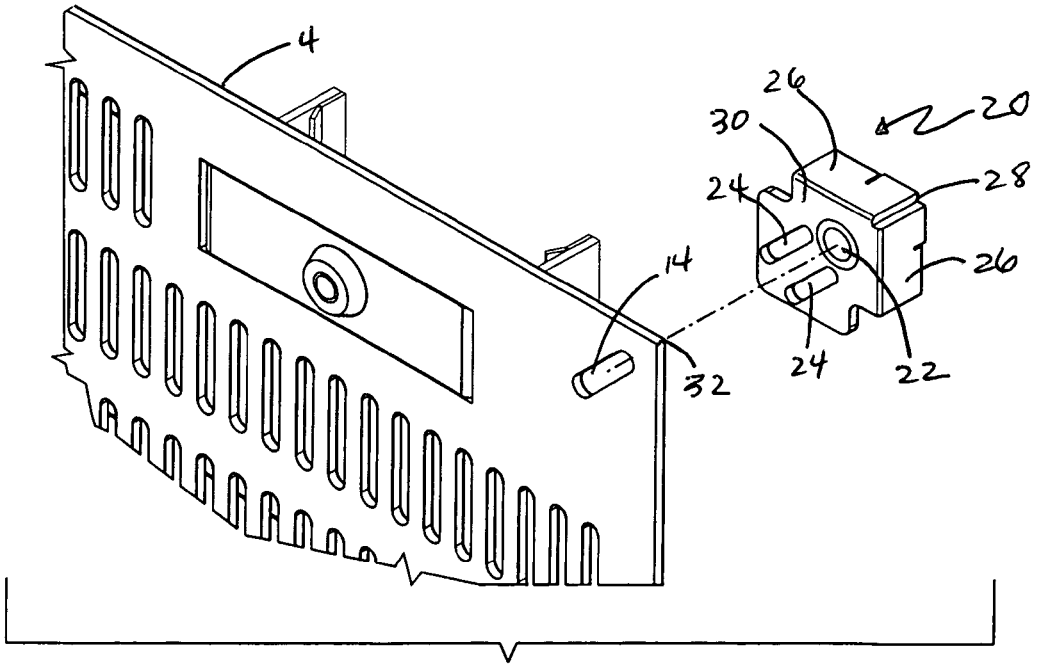
FIG. 2 is a perspective view of the floor panel and articulating bracket.

As shown in FIG. 2, in the preferred embodiment, the articulating corner bracket 20 is fabricated to include a threaded clear hole 22, a pair of lateral clear slots 24 in parallel alignment with the first diagonal slot 14 of the floor panel 10 and two side walls 26 forming a corner portion 28 for support of the floor panel 10 on pedestal support legs of a pedestal support system, with or without stringers. The threaded clear hole 22 is positioned below the floor panel 10 diagonal clear slot 14 so that the clear hole 22 is accessible through the upper surface 2 of the floor panel 10. The articulating corner bracket 20 includes an upper horizontal surface 30 which is slidably fastened to the lower surface 4 of the floor panel 10 and is positioned adjacent to each corner of the floor panel so that the articulating corner bracket 20 is capable of free longitudinal movement along a diagonal vector defined with respect to the corner portion 32 of the floor panel 10.

Figure 3:
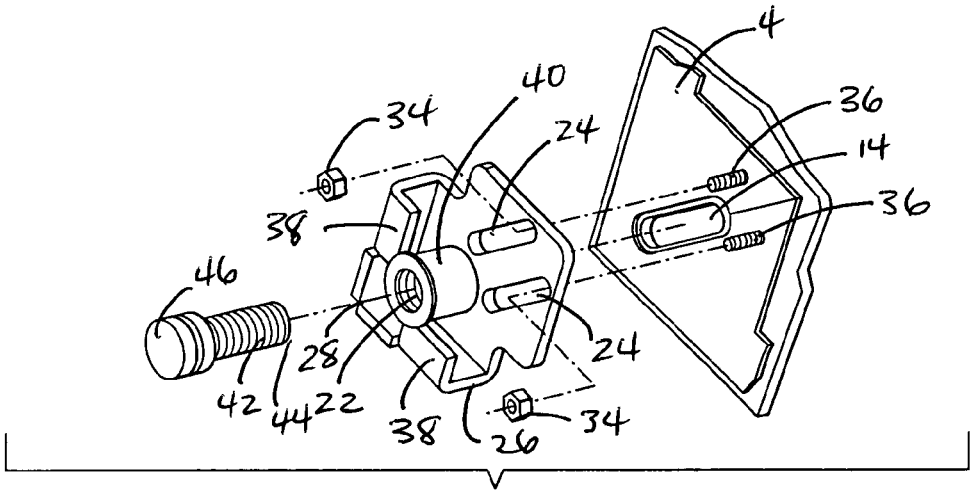
FIG. 3 is an exploded view of the articulating corner bracket which is slidably attached to an underside of a floor panel corner.

Referring now to FIG. 3, the preferred embodiment of the articulating floor panel assembly is shown in an exploded view from the underside, or lower surface 4, of the floor panel 10. The articulating corner bracket 20 is adjustably secured to the underside of the floor panel 10 with nuts 34 threaded onto bolts 36 fastened to the lower surface 4 of the floor panel 10, one each in alignment with one each of the lateral clear slots 24 so that the threaded end of each one of the bolts 36 extends downwardly through one each of the clear slots 24 in the articulating corner bracket 20. The sidewalls 26 of the articulating corner bracket 20 form a corner support portion 28 of the floor panel 10. The sidewalls 26 of the articulating corner bracket 20 desirably include lower flange 38 portions extending horizontally and inwardly for supporting a threaded cylinder 40. A set screw 42, having a threaded end 44 and a foot end 46 is threaded into the cylinder 40. The screw 42 preferably includes a hex head 48 which, which when threaded into the cylinder 40 is accessible through the diagonal clear slot 14 in floor panel 10 corner portion. In this manner vertical adjustment of the floor panel 10 assembly is accomplished using a tool, such as a hex driver, to raise and lower the panel with respect to the pedestal support system. The cylinder 40 is preferably secured to the flange 38 portions of the articulating corner bracket 20 side walls 26 using a weld. As shown in the drawings, the articulating corner bracket 20 is desirably fabricated by cutting a sheet of metal into a pattern and bending the pattern to form the sidewalls 26 and flange portions 38.

Figure 4:
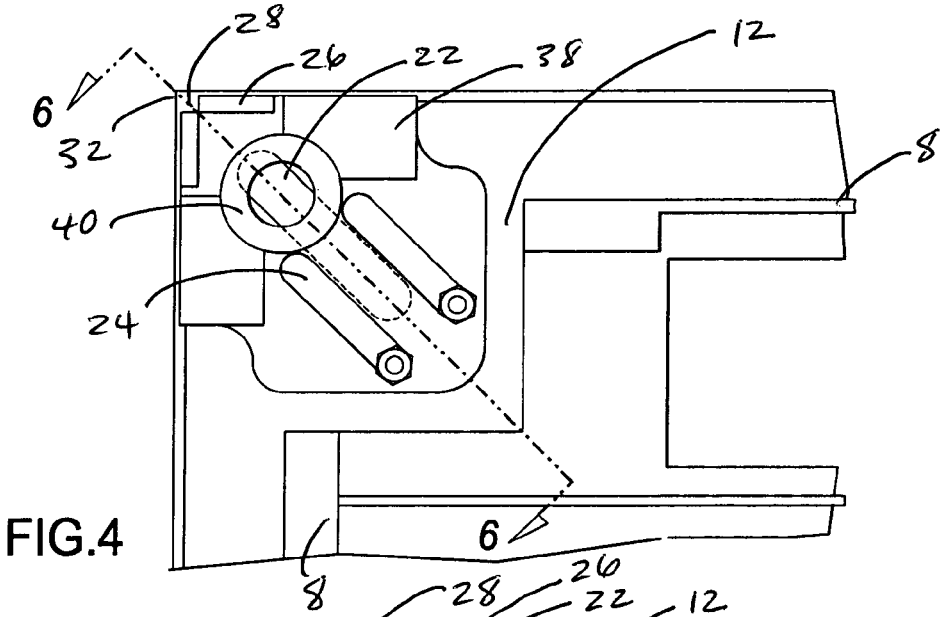
FIG. 4 is a bottom view of the articulating corner bracket adjusted outwardly in relation to a floor panel.
Figure 6:
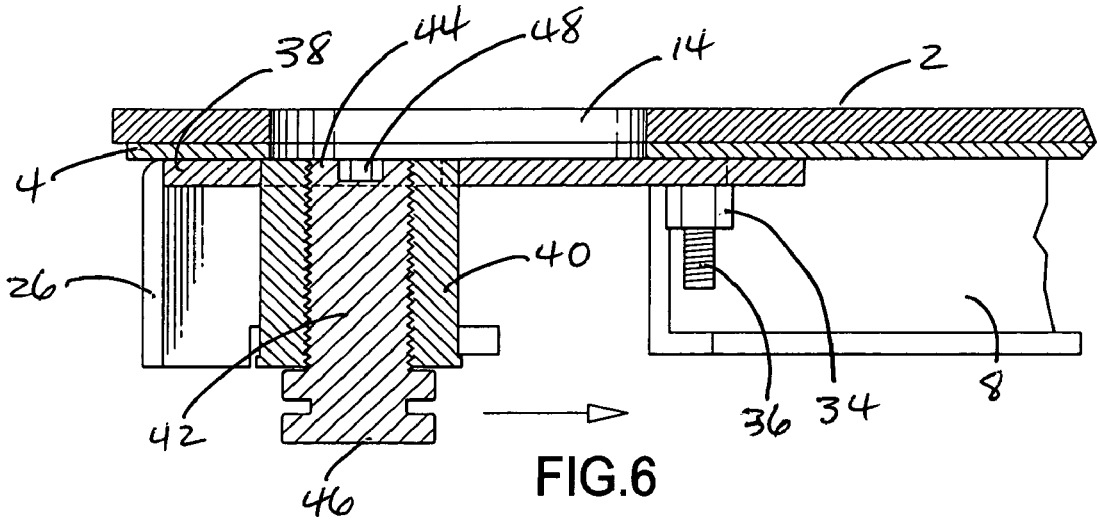
FIG. 6 is a sectional view along section six of FIG. 4.

Turning now to FIGS. 4, and 6, inward and outward movement of the articulating corner bracket 20 along the diagonal vector is shown in order to adjust the distance of the articulating corner bracket 20 in relation to the floor panel 10. In this manner, the articulating corner bracket 20 serves as a corner of the floor panel 10 for support on a bearing surface of the pedestal support system. In FIG. 4, the articulating corner bracket 20 is slidably secured at a maximum distance outwardly in relation to the corner portion of the floor panel. As shown in the drawing figure, the clear hole 22 of the threaded cylinder 40 is maintained in alignment with the diagonal clear slot 14 of the floor panel 10. Section 6 of FIG. 4 is a sectional view illustrated as drawing FIG. 6. In FIG. 6, the externally threaded screw 42 is threaded into the internally threaded cylinder 40 whereby the tool receiving head 48 of the threaded end 44 of the screw 42 is accessible for vertical operational adjustment of the screw 42 from the upper surface 2 of the floor panel 10 through the diagonal clear slot 14. As shown in FIG. 6, the externally threaded screw 42 is fully tightened with respect to the internally threaded cylinder 40 so that a minimum vertical distance relative to the floor panel 10 and a bearing surface of the pedestal support system is achieved. The upper surface 30 of the articulating corner bracket 20 is secured to the lower surface 4 of the floor panel 10 using a nut 34 threaded onto the bolt 36 which extends downwardly from the lower surface 4 of the floor panel 10. As shown in FIG. 6, the articulating corner bracket 20 is thereby fastened to the floor panel 10 at a maximum outward distance for adjusting the floor panel 10 to bear upon a pedestal support leg, or stringer, fixed at the floor panels 10 maximum overall dimensions. In the preferred embodiment, the maximum operational distance of the floor panel diagonal clear slot 14 and the articulating corner bracket 20 clear slots 24 is in a range of 6.35 to 38.1 millimeters.

Figure 5:
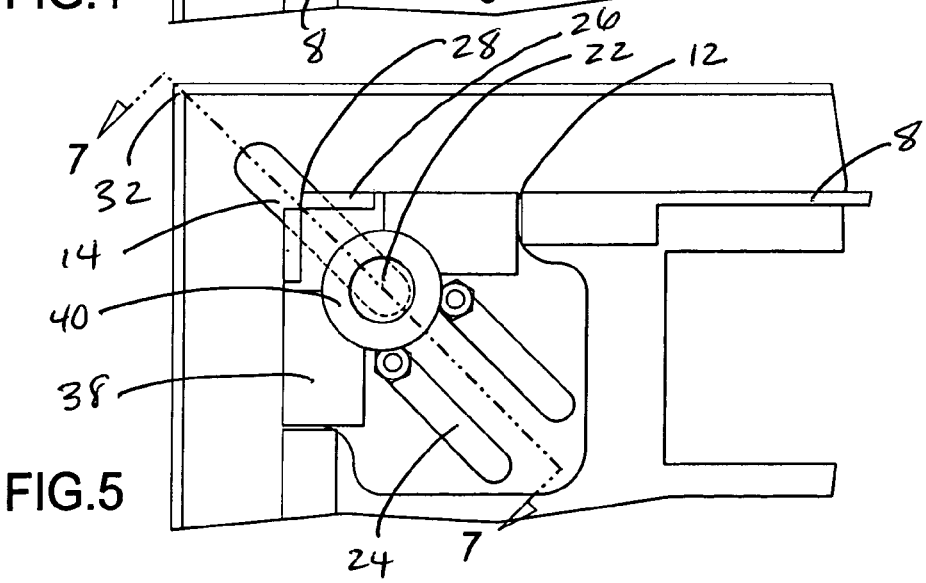
FIG. 5 is a bottom view of the articulating bracket slidably adjusted inwardly with respect to the floor panel corner.
Figure 7:
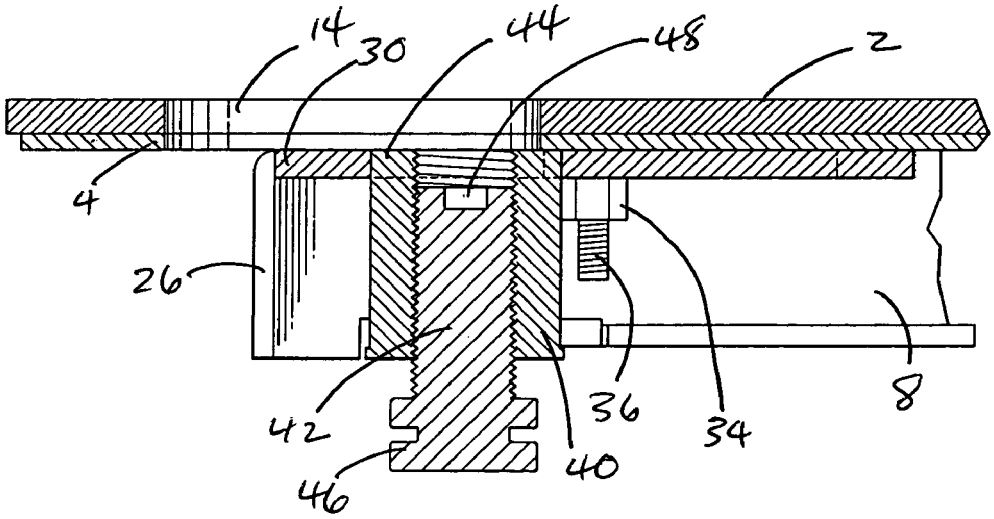
FIG. 7 is a sectional view along section seven of FIG. 5.

Referring now to FIGS. 5 and 7, the articulating corner bracket 20 is shown as positioned at its maximum inward position so that the floor panel 10 is at its minimum overall dimension with respect to a pedestal support system. Section 7 of FIG. 5 is shown as a sectional view in the drawing of FIG. 7. As shown in FIG. 7, the articulating corner bracket 20 is now secured to the floor panel 10 at its maximum inward position to generate a floor panel 10 having a minimum overall supporting dimension, using a nut 34 threaded onto a bolt 36. The nut 34 biases against the lower horizontal surface of the articulating corner bracket 20. Also shown in the drawing figure, the foot end 46 of the vertically adjustable screw 42 is now threaded downwardly using a hex head tool operated through the floor panel diagonal slot 14 so as to provide a greater overall vertical distance between the floor panel 10 and the pedestal support bearing surface.

The foregoing articulating floor panel assembly is an assembly which is capable of mass production, but which is also interchangeable with pedestal support systems fixed at varying predetermined positions. In this manner, it is a cost effective assembly in fabrication and is capable of inventory for rapid shipment because it eliminates the design-build approach for floor panels of the preexisting art. When installing the floor panel to a preexisting pedestal support system, one simply measures the dimensions of a desired mounting point, slides the articulating corner brackets 20 inwardly or outwardly along the diagonal vector so that the side walls 26 of the articulating corner bracket 20 are in alignment with the desired mounting point, and secures the articulating corner brackets 20 at the desired position. Moreover, when the articulating corner bracket 20 is fabricated to include the elements for vertical adjustment, the relative height of the floor panel with respect to a planer working surface is then adjusted by inserting a tool through the diagonal clear slot 14, and the articulating corner bracket clear hole 22, and operating the tool end 44 of the screw to achieve a relative distance between the floor panel 10 and the pedestal support system.

While the present invention has been described in connection with the illustrated embodiments, it will be appreciated and understood that modifications may be made without parting, from the true spirit and scope of the invention.

I claim:

1. An articulating raised access floor panel of the type for interchangeable fit on a pedestal support systems having pedestal support heads and pedestal support legs fixed to a base floor at varying predetermined positions, comprising:

(a) a floor panel having an upper surface, a lower plenum surface, and four side walls, two each of the sidewalls defining a corner portion of the floor panel;

(b) at least one stud having a stud end and a nut end, the stud end connected to the lower plenum surface adjacent to each of the corner portions in order for the nut end to project downwardly;

(c) a lower stringer support frame including at least four lateral beam members, each of the beam members connected to the lower plenum surface in a position substantially adjacent to a lateral edge of each of the side walls;

(d) an open support frame corner portion positioned at an intersection of each of the beam members; and (e) a clamp frame member having an upper wall and at least two side walls, the upper wall including at least one diagonal clear slot, the slot configured to receive the nut end, in order to slidably connect an upper surface of the clamp frame upper wall to the lower plenum surface in order to guide the clamp frame along a diagonal vector in relation to the beam members so that clamp frame sidewalls align to bias against a pedestal support head.

2. The floor panel according to claim 1, wherein the clamp frame-further comprises, an internally threaded collar connected to a lower surface of the upper wall for receiving a set screw having a foot end and a tool end, and wherein the floor panel further comprises, a diagonal clear slot cut into each of the floor panel corner portions having a centroid along the diagonal vector configured to receive a tool in order to operate the tool end in order to align the clamp frame vertically to bias against the pedestal head.

3. The floor panel according to claim 1, wherein the clamp frame upper wall clear slot has an operational distance in a range of 6.35-38.1 mm.

4. The floor panel according to claim 1, wherein the clamp frame side walls each further include a lower flange portion.

5. A method for retrofitting a floor panel to a pedestal support system having a plurality of pedestal support heads positioned on pedestal support legs at predetermined positions on a base floor, comprising the steps of:

(a) providing a floor panel having an upper surface, a lower plenum surface, and four side walls, two each of the sidewalls defining a corner portion of the floor panel;

(b) providing at least one stud having a stud end and a nut end, the stud end connected to the lower plenum surface adjacent to each of the corner portions in order for the nut end to project downwardly;

(c) providing a lower stringer support frame including at least four lateral beam members, each of the beam members connected to the lower plenum surface in a position substantially adjacent to a lateral edge of each of the side walls;

(d) providing an open support frame corner portion positioned at an intersection of each of the beam members;

(e) providing a clamp frame member having an upper wall and at least tow side walls, the upper wall including at least one diagonal clear slot, the slot configured to receive the nut end, in order to slidably connect an upper surface of the clamp frame upper wall to the lower plenum surface in order to guide the clamp frame along a diagonal vector in relation to the beam members;

(f) sliding the clamp frame along a diagonal vector defined with respect to the lateral beam members to a predetermined position in order to aligning the clamp frame sidewalls to bias against the pedestal support head; and (g) tightening the nut to securely fasten the clamp frame in the predetermined position.

6. The method according to claim 5, further comprising the steps of providing an internally threaded collar connected to a lower surface of the upper wall for receiving a set screw having a foot end and a tool end, and providing a diagonal clear slot cut into each of the floor panel corner portions, having a centroid along the diagonal vector, configured to receive a tool in order to operate the tool end, and adjusting the set screw in order to urge to floor panel vertically to a predetermined level on plane with an existing raised access floor.

7. The method according to claim 5, further comprising the step of providing an operational distance for the clamp frame upper wall diagonal clear slot in a range of 6.35-38.1 mm.

* * * * *